US010775078B2

(12) United States Patent
Xue et al.

(10) Patent No.: US 10,775,078 B2
(45) Date of Patent: Sep. 15, 2020

(54) GAS WATER HEATER AND SAFETY CONTROL METHOD AND SYSTEM THEREFOR

(71) Applicants: WUHU MIDEA KITCHEN AND BATH APPLIANCES MFG. CO., LTD., Wuhu (CN); MIDEA GROUP CO., LTD., Foshan (CN)

(72) Inventors: Chengzhi Xue, Wuhu (CN); Xianfeng Dai, Wuhu (CN); Liping Shou, Wuhu (CN); Zefeng Liang, Wuhu (CN); Guorong Liang, Wuhu (CN)

( * ) Notice: Subject to any disclaimer, the term of this patent is extended or adjusted under 35 U.S.C. 154(b) by 92 days.

(21) Appl. No.: 16/289,616

(22) Filed: Feb. 28, 2019

(65) Prior Publication Data

US 2019/0195532 A1 Jun. 27, 2019

Related U.S. Application Data

(63) Continuation of application No. PCT/CN2016/113792, filed on Dec. 30, 2016.

(30) Foreign Application Priority Data

Aug. 31, 2016 (CN) ..... 2016 1 0794742
Aug. 31, 2016 (CN) ..... 2016 2 1025272 U

(51) Int. Cl.
*F24H 9/20* (2006.01)
*F23N 3/08* (2006.01)
*F04D 27/00* (2006.01)

(52) U.S. Cl.
CPC ..... *F24H 9/205* (2013.01); *F04D 27/00* (2013.01); *F23N 3/082* (2013.01); *F23N 3/085* (2013.01); *F24H 9/20* (2013.01); *F24H 9/2035* (2013.01)

(58) Field of Classification Search
CPC ..... F24H 9/205
See application file for complete search history.

(56) References Cited

U.S. PATENT DOCUMENTS 5,902,098 A * 5/1999 Park ..... F23M 11/00 431/6
9,568,209 B2 * 2/2017 Rugge ..... F24F 11/77
(Continued)

FOREIGN PATENT DOCUMENTS

CN 1752523 A 3/2006
CN 101303161 A 11/2008
(Continued)

OTHER PUBLICATIONS

OA for CN application201610794742.5.
(Continued)

*Primary Examiner* — Nathaniel Herzfeld
(74) *Attorney, Agent, or Firm* — Kilpatrick Townsend & Stockton, LLP

(57) ABSTRACT

The present invention provides a gas water heater, and a safety control method and system therefor. The system includes: an exhaust fan; a rotational speed detecting unit, configured to detect a rotational speed of the exhaust fan; a power obtaining unit, configured to obtain a set value for output power of the exhaust fan; a rotational speed difference obtaining unit, configured to obtain an actual value of the rotational speed and a reference value of the rotational speed according to the set value for the output power, and to calculate a difference between them; and an exhaust control unit, connected to the exhaust fan, the rotational speed detecting unit, the rotational speed difference obtaining unit and the power obtaining unit respectively, configured to correct a predetermined wind pressure curve graph at an air outlet of the exhaust fan according to the difference.

13 Claims, 3 Drawing Sheets

(56) References Cited

U.S. PATENT DOCUMENTS

| | | | | |
|---|---|---|---|---|
| 2003/0030408 | A1 | 2/2003 | Ratz et al. | |
| 2007/0289322 | A1* | 12/2007 | Mathews | F24F 11/77 62/225 |
| 2010/0195991 | A1 | 8/2010 | Deivasigamani et al. | |
| 2013/0071261 | A1* | 3/2013 | Huang | F23N 3/082 417/63 |
| 2014/0116357 | A1* | 5/2014 | Yano | F24D 19/0095 122/14.2 |
| 2017/0356675 | A1* | 12/2017 | Post | F24H 9/2035 |

FOREIGN PATENT DOCUMENTS

| | | | |
|---|---|---|---|
| CN | 201561578 | U | 8/2010 |
| CN | 102080878 | A | 6/2011 |
| CN | 102192808 | A | 9/2011 |
| CN | 202158666 | U | 3/2012 |
| CN | 202813802 | U | 3/2013 |
| CN | 103727676 | A | 4/2014 |
| JP | S62169929 | A | 7/1987 |
| JP | S63176920 | A | 7/1988 |
| JP | H08152131 | A | 6/1996 |
| JP | H08320116 | A | 12/1996 |
| JP | H09261988 | A | 10/1997 |
| JP | H09303767 | A | 11/1997 |
| JP | H10110944 | A | 4/1998 |
| JP | H10122562 | A | 5/1998 |
| JP | H10220741 | A | 8/1998 |
| JP | H1151387 | A | 2/1999 |
| JP | 2006094575 | A | 4/2006 |
| JP | 2013015298 | A | 1/2013 |
| WO | 2009107897 | A1 | 9/2009 |

OTHER PUBLICATIONS

EP Office Action dated Dec. 11, 2017 in the corresponding EP application (application No. 16869366.1).

The Office Action dated Mar. 16, 2020 corresponding to JP application No. 2019-512266.

The second Office Action dated Jul. 8, 2019 in the corresponding CN application No. 201610794742.5.

* cited by examiner

GAS WATER HEATER AND SAFETY CONTROL METHOD AND SYSTEM THEREFOR

CROSS-REFERENCE

This application is a continuation of International Application No. PCT/CN2016/113792, filed on Dec. 30, 2016, which claims priority to the Chinese Application No. 201610794742.5 and 201621025272.8, filed on Aug. 31, 2016, which are incorporated herein by reference in their entireties.

TECHNICAL FIELD

The present disclosure relates to the water heater technology field, and more particular to, a gas water heater, a safety control method for a gas water heater, and a safety control system for a gas water heater.

BACKGROUND

At present, gas water heaters on the market typically include: D type (natural exhaust type) gas water heaters, Q type (forced exhaust type) gas water heaters, P type (natural exhaust and air supply type) gas water heaters, G type (forced exhaust and air supply type) gas water heaters and W type (outside set-up type) gas water heaters and so on. Q type and G type gas water heaters are provided with exhaust fans directly, so as to forcedly exhaust waste gas generated when burning gas, such that the residual gas explosion or the like may be avoided.

In the related art, the Q type gas water heater mostly adopts a wind pressure detecting unit to detect the wind pressure at an air outlet and controls the exhaust fan and an igniter unit according to the detected wind pressure, so as to ensure that the gas water heater may work normally. Although the combustion operation of the gas water heater in the case of the wind flow backward may be avoided by adopting the wind pressure detecting unit, the device cost is high, and the operation of the gas water heater may be interrupted due to the slight wind pressure, such that the user is unable to use the gas water heater normally.

SUMMARY

The present disclosure aims to solve at least one of the above technical problems in the related art to at least some extent.

Accordingly, a first objective of the present disclosure aims to provide a safety control system for a gas water heater. The safety control system may ensure that the gas water heater can have a good combustion condition and operate safely and reliably. Also, the response speed of the system is fast and accurate air volume may be provided, such that the control accuracy is improved.

A second objective of the present disclosure aims to provide a gas water heater.

A third objective of the present disclosure aims to provide a safety control method for a gas water heater.

In order to achieve the above objectives, embodiments of a first aspect of the present disclosure provide a safety control system for a gas water heater, including: an exhaust fan, configured to exhaust waste gas generated when the gas water heater burns gas; a rotational speed detecting unit, configured to detect a rotational speed of the exhaust fan; a power obtaining unit, configured to obtain a set value for output power of the exhaust fan; a rotational speed difference obtaining unit, configured to obtain an actual value of the rotational speed and a reference value of the rotational speed according to the set value for the output power, and to calculate a difference between the actual value of the rotational speed and the reference value of the rotational speed; and an exhaust control unit, connected to the exhaust fan, the rotational speed detecting unit, the rotational speed difference obtaining unit and the power obtaining unit respectively, and configured to correct a predetermined wind pressure curve graph at an air outlet of the exhaust fan according to the difference, to determine a wind pressure situation at the air outlet according to the rotational speed, a corrected wind pressure curve graph and the set value for the output power, and to adjust the set value for the output power according to the wind pressure situation, in which the predetermined wind pressure curve graph includes a polarity of curves each indicating a predetermined rotational speed as a function of the set value for the output power.

With the safety control system for a gas water heater according to embodiments of the present disclosure, firstly the power obtaining unit obtains the set value for the output power of the exhaust fan and the rotational speed difference obtaining unit obtains the actual value of the rotational speed of the exhaust fan and the reference value of the rotational speed according to the set value for the output power and calculates the difference between the actual value of the rotational speed and the reference value of the rotational speed, and then the exhaust control unit corrects a predetermined wind pressure curve graph at an air outlet of the exhaust fan according to the difference between the actual value of the rotational speed and the reference value of the rotational speed, determines the wind pressure situation at the air outlet at the air outlet according to the rotational speed, a corrected wind pressure curve graph and the set value for the output power and adjusts the set value for the output power according to the wind pressure situation, such that the adjustment of air volume of the exhaust fan may be realized, and it is guaranteed that a good combustion condition may be achieved after mixing the introduced gas and air during the operation of the gas water heater, and the gas water heater can operate safely and reliably. Meanwhile, the direct adjustment of the set value for the output power is an active control, which has a fast response speed and provides more accurate air volume when compared to the passive control on the rotational speed of the exhaust fan, such that the control accuracy is improved.

In addition, the safety control system for a gas water heater according to the above embodiments of the present disclosure may further have following additional technical features.

According to an embodiment of the present disclosure, the exhaust control unit is configured to correct the predetermined wind pressure curve graph at an air outlet of the exhaust fan according to the difference by making the corrected wind pressure curve graph include a plurality of curves each indicating a sum of the difference and the predetermined rotational speed as a function of the set value for the output power.

According to an embodiment of the present disclosure, the exhaust control unit is configured to determine a wind pressure situation at the air outlet according to the rotational speed, a corrected wind pressure curve graph and the set value for the output power and to adjust the set value for the output power according to the wind pressure situation by performing following acts: controlling the set value for the output power to be reduced by a first predetermined value when the exhaust control unit determines that the wind pressure situation is a low wind pressure situation; controlling the set value for the output power to keep unchanged when the exhaust control unit determines that the wind pressure situation is a medium wind pressure situation; and controlling the set value for the output power to be increased by a second predetermined value when the exhaust control unit determines that the wind pressure situation is a high wind pressure situation.

According to an embodiment of the present disclosure, the above safety control system further includes a system control unit configured to perform a mutual communication with the exhaust control unit, in which the exhaust control unit is configured to send a shut-off signal to the system control unit such that the system control unit controls the gas water heater to shut off according to the shut-off signal, when the exhaust control unit determines that the wind pressure situation is an extreme high wind pressure situation or the rotational speed is higher than a rotational speed threshold.

According to an embodiment of the present disclosure, the above safety control system further includes a water supply unit, connected to the system control unit; a temperature obtaining unit, connected with the system control unit, configured to obtain a set temperature for output water of the gas water heater and a cold water temperature of the gas water heater; in which the system control unit is configured to calculate a total heat required by the gas water heater according to a water supply quantity of the water supply unit, the set temperature for the output water and the cold water temperature, and to obtain a current control instruction and an initial set value for the output power according to the total heat.

According to an embodiment of the present disclosure, the above safety control system further includes a gas unit, connected to the system control unit and provided with a proportional valve, in which the system control unit is configured to control the gas unit by controlling the proportional valve according to the current control instruction.

According to an embodiment of the present disclosure, the gas water heater is a forced exhaust type gas water heater.

In order to achieve the above objectives, embodiments of a second aspect of the present disclosure provide a gas water heater, including the above safety control system.

With the above safety control system, the gas water heater according to embodiments of the present disclosure may correct the predetermined wind pressure curve graph at the air outlet of the exhaust fan according to the difference between the actual value of the rotational speed and the reference value of the rotational speed, determine the wind pressure situation at the air outlet of the exhaust fan according to the rotational speed, the corrected wind pressure curve graph and the set value for the output power and adjust the set value for the output power according to the wind pressure situation, such that the adjustment of air volume of the exhaust fan may be realized, and it is guaranteed that a good combustion condition may be achieved after mixing the introduced gas and air during the operation of the gas water heater, thus ensuring the safe and reliable operation of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved.

In order to achieve the above objectives, embodiments of a third aspect of the present disclosure provide a safety control method for a gas water heater, including: obtaining a set value for output power of an exhaust fan in the gas water heater and a reference value of a rotational speed of the exhaust fan corresponding to the set value for the output power; obtaining an actual value of the rotational speed according to the set value for the output power, and calculating a difference between the actual value of the rotational speed and the reference value of the rotational speed; correcting a predetermined wind pressure curve graph at an air outlet of the exhaust fan according to the difference, in which the predetermined wind pressure curve graph includes a plurality of curves each indicating a predetermined rotational speed as a function of the set value for the output power; detecting the rotational speed of the exhaust fan; and determining a wind pressure situation at an air outlet of the exhaust fan according to the rotational speed, a corrected wind pressure curve graph and the set value for the output power, and adjusting the set value for the output power according to the wind pressure situation.

With the safety control method for a gas water heater according to embodiments of the present disclosure, firstly the set value for output power of the exhaust fan and corresponding reference value of the rotational speed are obtained, and the actual value of the rotational speed of the exhaust fan is obtained according to the set value for the output power and the difference between the actual value of the rotational speed and the reference value of the rotational speed is calculated, and the predetermined wind pressure curve graph at the air outlet of the exhaust fan is corrected according to the difference. And then, the rotational speed of the exhaust fan is detected, the wind pressure situation at the air outlet of the exhaust fan is determined according to the rotational speed, the corrected wind pressure curve graph and the set value for the output power, and the set value for the output power is adjusted according to the wind pressure situation, such that the adjustment of air volume of the exhaust fan may be realized, and it is guaranteed that a good combustion condition may be achieved after mixing the introduced gas and air during the operation of the gas water heater, thus ensuring a safe and reliable operation of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved.

In addition, the safety control method for a gas water heater according to the above embodiments of the present disclosure may further have following additional technical features.

According to an embodiment of the present disclosure, correcting a predetermined wind pressure curve graph at an air outlet of the exhaust fan according to the difference includes: making the corrected wind pressure curve graph include a plurality of curves each indicating a sum of the difference and the predetermined rotational speed as a function of the set value for the output power.

According to an embodiment of the present disclosure, determining a wind pressure situation at an air outlet of the exhaust fan according to the rotational speed, a corrected wind pressure curve graph and the set value for the output power, and adjusting the set value for the output power according to the wind pressure situation includes: controlling the set value for the output power to be reduced by a first predetermined value when it is determined that the wind pressure situation is a low wind pressure situation; controlling the set value for the output power to keep unchanged when it is determined that the wind pressure situation is a medium wind pressure situation; and controlling the set value for the output power to be increased by a second predetermined value when it is determined that the wind pressure situation is a high wind pressure situation.

According to an embodiment of the present disclosure, determining a wind pressure situation at an air outlet of the exhaust fan according to the rotational speed, a corrected wind pressure curve graph and the set value for the output power, and adjusting the set value for the output power according to the wind pressure situation further includes: controlling the gas water heater to shut off, when it is determined that the wind pressure situation is an extreme high wind pressure situation or the rotational speed is higher than a rotational speed threshold.

According to an embodiment of the present disclosure, the above safety control method further includes: obtaining a water supply quantity of the gas water heater, a set temperature for output water of the gas water heater and a cold water temperature of the gas water heater; calculating a total heat required by the gas water heater according to the water supply quantity, the set temperature for the output water and the cold water temperature, and obtaining a current control instruction and an initial set value for the output power according to the total heat; and performing a gas burning control by controlling a proportional valve in a gas unit of the gas water heater according to the current control instruction.

DETAILED DESCRIPTION

Figure 1:
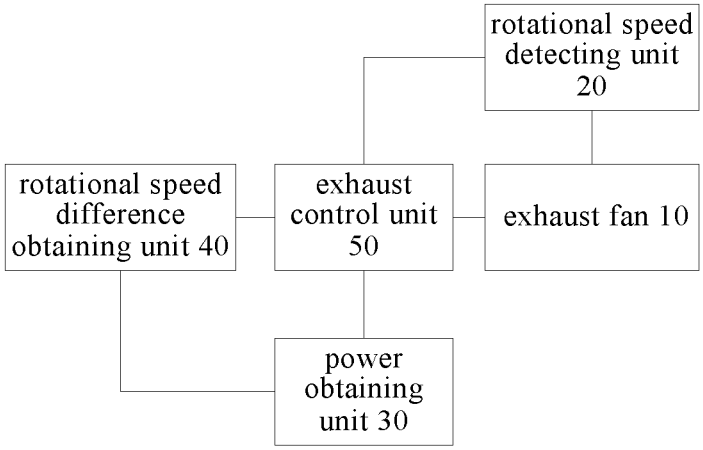
FIG. 1 is a block diagram of a safety control system for a gas water heater according to an embodiment of the present disclosure.

Embodiments of the present disclosure will be described in detail and examples of the embodiments will be illustrated in the accompanying drawings. The same or similar elements and the elements having same or similar functions are denoted by like reference numerals throughout the descriptions. The embodiments described herein with reference to the drawings are explanatory, which aim to illustrate the present disclosure, but shall not be construed to limit the present disclosure.

In the following, a gas water heater and a safety control system and method therefor according to embodiments of the present disclosure will be described with reference to the drawings.

FIG. 1 is a block diagram of a safety control system for a gas water heater according to an embodiment of the present disclosure. As shown in FIG. 1, the safety control system for a gas water heater includes an exhaust fan 10, a rotational speed detecting unit 20, a power obtaining unit 30, a rotational speed difference obtaining unit 40 and an exhaust control unit 50.

The exhaust fan 10 is configured to exhaust waste gas generated when the gas water heater burns gas. The rotational speed detecting unit 20 is configured to detect a rotational speed of the exhaust fan. The power obtaining unit 30 is configured to obtain a set value for output power of the exhaust fan. The rotational speed difference obtaining unit 40 is configured to obtain an actual value of the rotational speed of the exhaust fan and a reference value of the rotational speed according to the set value for the output power and to calculate a difference between the actual value of the rotational speed and the reference value of the rotational speed. The exhaust control unit 50 is connected to the exhaust fan 10, the rotational speed detecting unit 20, the power obtaining unit 30 and the rotational speed difference obtaining unit 40 respectively. The exhaust control unit 50 is configured to correct a predetermined wind pressure curve graph at an air outlet of the exhaust fan 10 according to the difference between the actual value of the rotational speed and the reference value of the rotational speed, to determine a wind pressure situation at the air outlet of the exhaust fan 10 according to the rotational speed of the exhaust fan 10, a corrected wind pressure curve graph and the set value for the output power of the exhaust fan 10, and to adjust the set value for the output power of the exhaust fan 10. The predetermined wind pressure curve graph includes a plurality of curves each indicating a predetermined rotational speed as a function of the set value for the output power.

Specifically, during the production stage of the gas water heater, the set value for the output power of the exhaust fan 10 is obtained by the power obtaining unit 30. Under a reference condition, a sampling and comparison program is executed. In other words, the rotational speed difference obtaining unit 40 obtains the actual value of the rotational speed according to the set value for the output power of the exhaust fan 10, and calculates the difference between the actual value of the rotational speed and the reference value of the rotational speed, and the exhaust control unit 50 corrects the predetermined wind pressure curve graph at the air outlet of the exhaust fan 10 according to the difference between the actual value of the rotational speed and the reference value of the rotational speed, in which the predetermined wind pressure curve graph includes a plurality of curves each indicating a predetermined rotational speed as a function of the set value for the output power (such as three predetermined rotational speeds). Further, the rotational speed of the exhaust fan 10 is detected by the rotational speed detecting unit 20 in real time, and the wind pressure situation at the air outlet of the exhaust fan 10 is determined in combination with the corrected wind pressure curve graph and the set value for the output power of the exhaust fan 10, and then the set value for the output power of the exhaust fan 10 is adjusted according to the wind pressure situation, such that the adjustment of air volume of the exhaust fan 10 may be realized, and it is guaranteed that a good combustion condition may be achieved after mixing the introduced gas and air during the operation of the gas water heater, thus ensuring the safety and reliability of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved and the whole system cost is low.

It can be understood that, the set value for output power of the exhaust fan 10 used for calculating the difference between the actual value of rotational speed and the reference value of the rotational speed may be different from the set value for output power used for determining the wind pressure situation. The set value for output power used for determining the wind pressure situation is the same as the set value for output power to be adjusted.

In an embodiment of the present disclosure, when correcting the predetermined wind pressure curve graph at the air outlet of the exhaust fan 10 according to the difference between the actual value of the rotational speed and the reference value of the rotational speed, the exhaust control unit 50 makes the corrected wind pressure curve graph include a plurality of curves each indicating a sum of the difference and the predetermined rotational speed as a function of the set value for the output power.

Further, when the exhaust control unit 50 determines the wind pressure situation at the air outlet of the exhaust fan 10 according to the rotational speed of the exhaust fan 10, the corrected wind pressure curve graph and the set value for the output power of the exhaust fan 10 and adjusts the set value for the output power of the exhaust fan 10 according to the wind pressure situation of the exhaust fan 10, the set value for the output power of the exhaust fan 10 is controlled to be reduced by a first predetermined value when the exhaust control unit 50 determines that the wind pressure situation of the exhaust fan 10 is a low wind pressure situation; the set value for the output power of the exhaust fan 10 is controlled to be unchanged when the exhaust control unit 50 determines that the wind pressure situation of the exhaust fan 10 is a medium wind pressure situation; and the set value for the output power of the exhaust fan 10 is controlled to be increased by a second predetermined value when the exhaust control unit 40 determines that the wind pressure situation of the exhaust fan 10 is a high wind pressure situation. The first predetermined value and the second predetermined value may be determined according to actual situations, which may be fixed values or may be adjusted dynamically according to actual situations.

Figure 2:
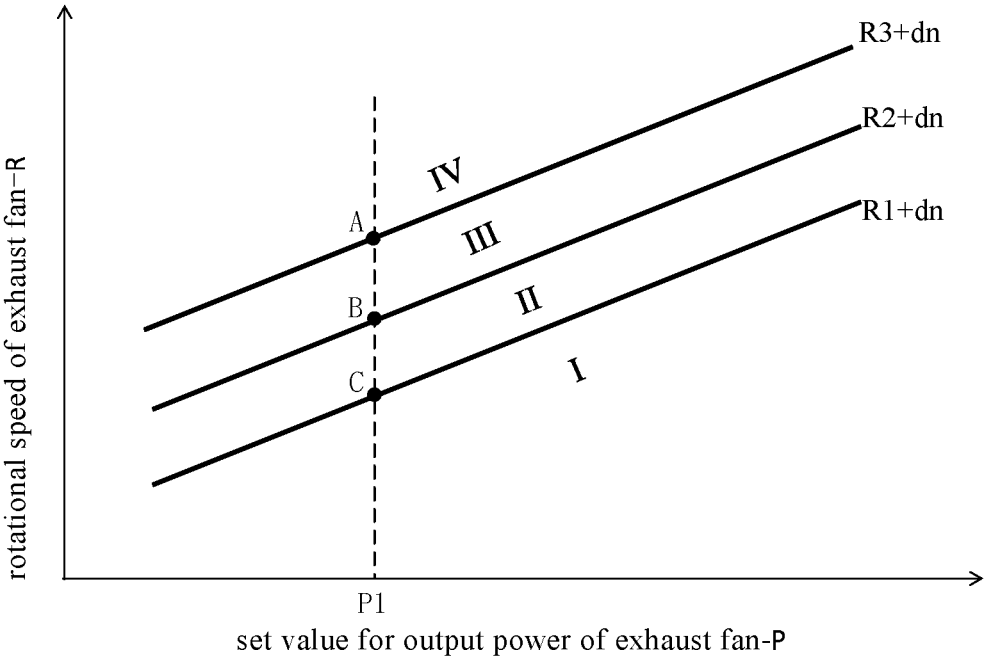
FIG. 2 is a schematic diagram illustrating a relationship between a set value for output power of an exhaust fan and a rotational speed of the exhaust fan according to an embodiment of the present disclosure.

Specifically, as shown in FIG. 2, in the case of a certain set value for output power of the exhaust fan 10, if the rotational speed R of the exhaust fan 10 is below the first curve R1+dn (Region I), it indicates that the wind pressure at the air outlet of the exhaust fan 10 is small, then the exhaust control unit 50 controls the set value for output power of the exhaust fan 10 to be reduced by the first predetermined value, i.e., the set value for output power is: $P=P-\Delta P1$, such that the output power of the exhaust fan 10 is decreased; if the rotational speed R of the exhaust fan 10 is above the first curve R1+dn but below the second curve R2+dn (Region II), it indicates that the wind pressure at the air outlet of the exhaust fan 10 is appropriate and the rotational speed of the exhaust fan 10 is naturally increased due to the physical characteristic of the exhaust fan as the wind pressure increases, such that it is unnecessary to adjust the set value for output power of the exhaust fan 10; if the rotational speed R of the exhaust fan 10 is above the second curve R2+dn but below the third curve R3+dn (Region III), it indicates that the wind pressure at the air outlet of the exhaust fan 10 is large, then the exhaust control unit 50 controls the set value for output power of the exhaust fan 10 to be increased by the second predetermined value, i.e., the set value for output power is: $P=P+\Delta P2$, such that the output power of the exhaust fan 10 is increased. dn is the difference between the actual value of the rotational speed and the reference value of the rotational speed of the exhaust fan 10. Since there may be difference in the performances of different exhaust fans and performances of whole systems when the gas water heaters are produced in batches, the control accuracy of the gas water heater may be affected. Therefore, the difference correction may be performed on the rotational speed curve (predetermined wind pressure curve) of the exhaust fan based on the difference of the actual value of the rotational speed and the reference value of the rotational speed of the exhaust fan 10.

In other words, when the set value for output power of the exhaust fan 10 is P1, if the detected rotational speed of the exhaust fan 10 meets a condition of $R<C$, then the set value for the output power of the exhaust fan 10 is adjusted to $P1-\Delta P1$; if the rotational speed meets a condition of $C\leq R<B$, then the set value for output power of the exhaust fan 10 is unchanged; if the rotational speed meets a condition of $B\leq R<A$, then the set value for the output power of the exhaust fan 10 is adjusted to $P1+\Delta P2$, such that the active control on the rotational speed of the exhaust fan is realized, and it is guaranteed that the air volume of the exhaust fan reaches an equilibrium with the wind pressure at the air outlet and the gas water heater would have a good combustion condition.

It should be noted that, the relationship between the set value for the output power of the exhaust fan and each of the first curve R1+dn, the second curve R2+dn and the third curve R3+dn shown in FIG. 2 refers to the corrected wind pressure curve. R1, R2 and R3 are a plurality of predetermined rotational speeds. Each of R1, R2 and R3 is a rotational speed value preset and stored in advance, and configured to determine the wind pressure situation at the air outlet of the exhaust fan 10.

Furthermore, it should be noted that, the predetermined wind pressure curve graph at the air outlet of the exhaust fan 10 may be corrected only when the gas water heater works for first time, such that the safety control time of the gas water heater may be reduced, and the power consumption is decreased.

Figure 3:
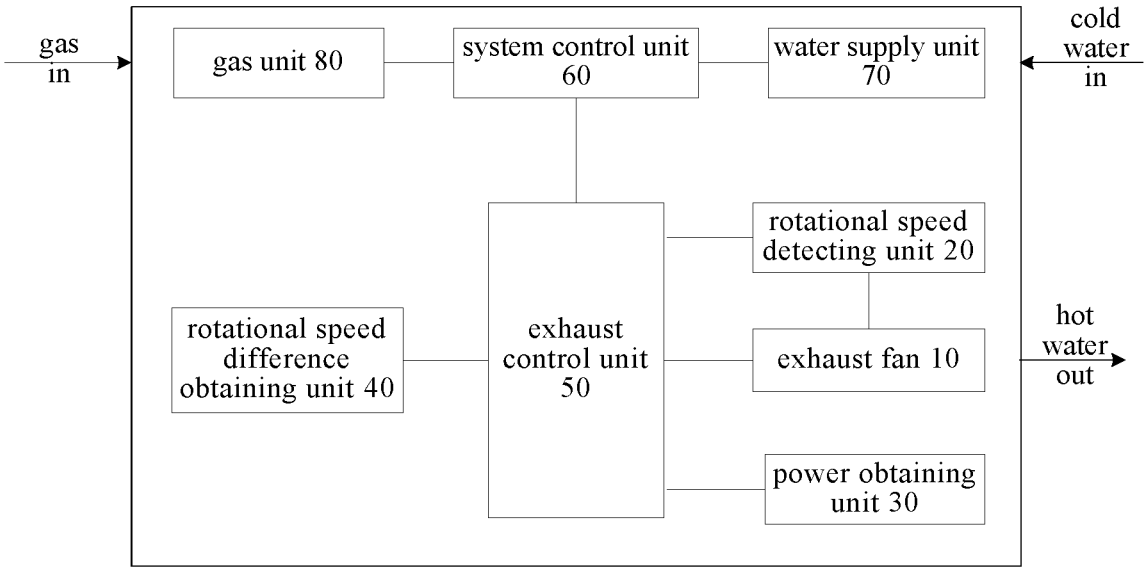
FIG. 3 is a block diagram of a safety control system for a gas water heater according to another embodiment of the present disclosure.

According to an embodiment of the present disclosure, as shown in FIG. 3, the above safety control system for a gas water heater further includes a system control unit 60. The system control unit 60 is configured to perform a mutual communication with the exhaust control unit 50. If the exhaust control unit 50 determines the wind pressure situation at the air outlet is an extreme high wind pressure situation or the rotational speed of the exhaust fan 10 is higher than a rotational speed threshold, the exhaust control unit 50 sends a shut-off signal to the system control unit 60, such that the system control unit 60 controls the gas water heater to shut off according to the shut-off signal.

Specifically, as shown in FIG. 2, in the case of a certain set value for output power of the exhaust fan 10, if the rotational speed R of the exhaust fan 10 is above the third curve R3+dn (Region IV), it indicates that the wind pressure at the air outlet of the exhaust fan 10 is too high, then it is necessary to control the gas water heater to shut off. For example, when the set value for output power of the exhaust fan 10 is P1, if the rotational speed of the exhaust fan 10 meets a condition of R≥A, then the gas water heater is controlled to shut off. Alternatively, if the rotational speed of the exhaust fan 10 is higher than a predetermined rotational speed threshold (upper limit for the rotational speed), then the gas water heater is controlled to shut off. In this way, the safety of the gas water heater is guaranteed.

According to an embodiment of the present disclosure, as shown in FIG. 3, the above safety control system for a gas water heater further includes a water supply unit 70 and a temperature obtaining unit (not shown). The water supply unit 70 is connected to the system control unit 60, and the temperature obtaining unit is also connected to the system control unit 60. The temperature obtaining unit is configured to obtain set temperature for output water of the gas water heater and a cold water temperature of the gas water heater. The system control unit 60 is configured to calculate a total heat required by the gas water heater according to a water supply quantity of the water supply unit 70, the set temperature for the output water and the cold water temperature, and to obtain a current control instruction and an initial set value for the output power of the exhaust fan 10 according to the total heat.

Further, as shown in FIG. 3, the above safety control system for a gas water heater further includes a gas unit 80 connected to the system control unit 60 and provided with a proportional valve (not shown). The system control unit 60 is configured to control the gas unit 80 by controlling the proportional valve according to the current control instruction.

Figure 4:
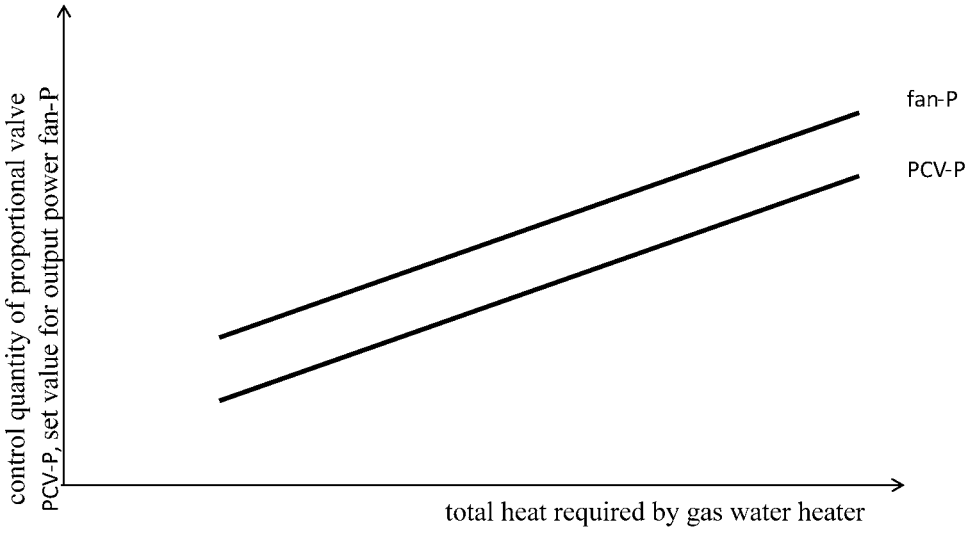
FIG. 4 is a schematic diagram illustrating a relationship between total heat required by a gas water heater and a controlled quantity of a proportional valve and a set value for output power of an exhaust fan according to an embodiment of the present disclosure.
Figure 5:
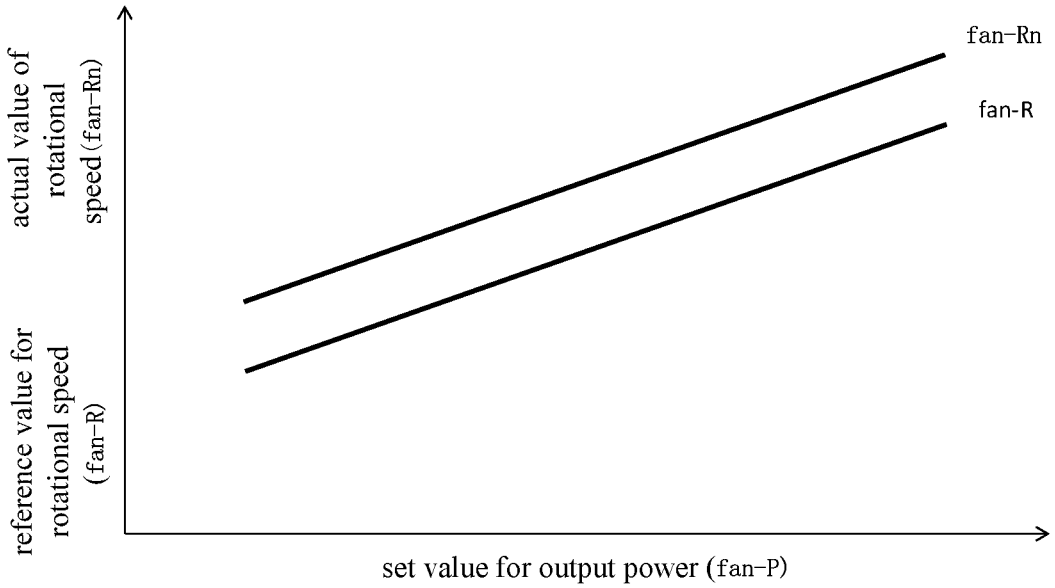
FIG. 5 is a schematic diagram illustrating a relationship between a set value for output power of an exhaust fan and an actual value of the rotational speed of an exhaust fan and a reference value of the rotational speed of the exhaust fan according to an embodiment of the present disclosure.

Specifically, after the gas water heater is energized, the system control unit 60 firstly calculates the total heat required by the gas water heater for warming the cold water to the set temperature for output water according to the set temperature for output water set by the user, the water supply quantity of the water supply unit 70 and the cold water temperature. And then, as shown in FIG. 4, the system control unit 60 obtains the control quantity of the proportional valve in the gas unit 80 and the set value for output power to be configured as an initial set value for output power according to the total heat required by the gas water heater. Finally, the system control unit 50 controls the proportional valve according to the obtained control quantity so as to control the gas unit 80, and sends the initial set value for output power to the exhaust control unit 50 via the CAN bus or the like. If should be noted that, as shown in FIG. 5, during the production stage or the first usage of the gas water heater, the reference value for the rotational speed of the exhaust fan 10 may be obtained according to the set value for output power of the exhaust fan 10, and a sampling and comparison program is executed, i.e., the actual value of the rotational speed corresponding to the set value for output power is detected, so as to obtain the difference between the actual value of the rotational speed and the reference value of the rotational speed. And then, the exhaust control unit may correct the predetermined wind pressure curve graph at the air outlet of the exhaust fan according to the difference.

It may be understood that, the set value for output power obtained according to the total heat required by the gas water heater is the same as the set value for output power used to determine the wind pressure situation at the air outlet and the set value for output power to be adjusted.

After correcting the predetermined wind pressure curve graph at the air outlet of the exhaust fan 10 and receiving the initial set value for output power, the exhaust control unit 50 controls the exhaust fan 10 according to the initial set value for output power and detects the rotational speed of the exhaust fan 10 through the rotational speed detecting unit 30 in real time. If the detected rotational speed is located in region I of the corrected wind pressure curve graph, then set value for output power of the exhaust fan 10 is $P=P_{initial}-\Delta P1$. $P_{initial}$ represents the initial set value for output power. If the detected rotational speed is located in region II, then set value for output power of the exhaust fan 10 is $P=P_{initial}$. If the detected rotational speed is located in region III, then set value for output power of the exhaust fan 10 is $P=P_{initial}+\Delta P2$. And so on, if the rotational speed of the exhaust fan 10 is located in region IV in the case of a certain set value for output power, or the rotational speed of the exhaust fan 10 is higher than the rotational speed threshold, or a shut-off instruction is received from the user, then the gas water heater is controlled to shut off.

During the operation of the gas water heater, if the set temperature for output water is changed, or the water supply quantity of the water supply unit 70 is changed, then the system control unit 60 obtains the control quantity of the proportional valve and the initial set value for output power again, and controls the gas water heater based on the above-mentioned procedure.

In an embodiment of the present disclosure, the gas water heater may be a forced exhaust type gas water heater, which is not limited herein.

With the safety control system for a gas water heater according to embodiments of the present disclosure, firstly the power obtaining unit obtains the set value for the output power of the exhaust fan, and a sampling and comparison program is executed, the rotational speed difference obtaining unit obtains the actual value of the rotational speed of the exhaust fan according to the set value for the output power and the calculates the difference between the actual value of the rotational speed and the reference value of the rotational speed, and then the exhaust control unit corrects a predetermined wind pressure curve graph at an air outlet of the exhaust fan according to the difference between the actual value of the rotational speed and the reference value of the rotational speed, determines the wind pressure situation at the air outlet at the air outlet according to the rotational speed, a corrected wind pressure curve graph and the set value for the output power and adjusts the set value for the output power according to the wind pressure situation, such that the adjustment of air volume of the exhaust fan may be realized, and it is guaranteed that a good combustion condition may be achieved after mixing the introduced gas and air during the operation of the gas water heater, thus ensuring the gas water heater can operate safely and reliably. Meanwhile, the direct adjustment of the set value for the output power is an active control, which has a fast response speed and provides more accurate air volume when compared to the passive control on the rotational speed of the exhaust fan, such that the control accuracy is improved.

Figure 6:
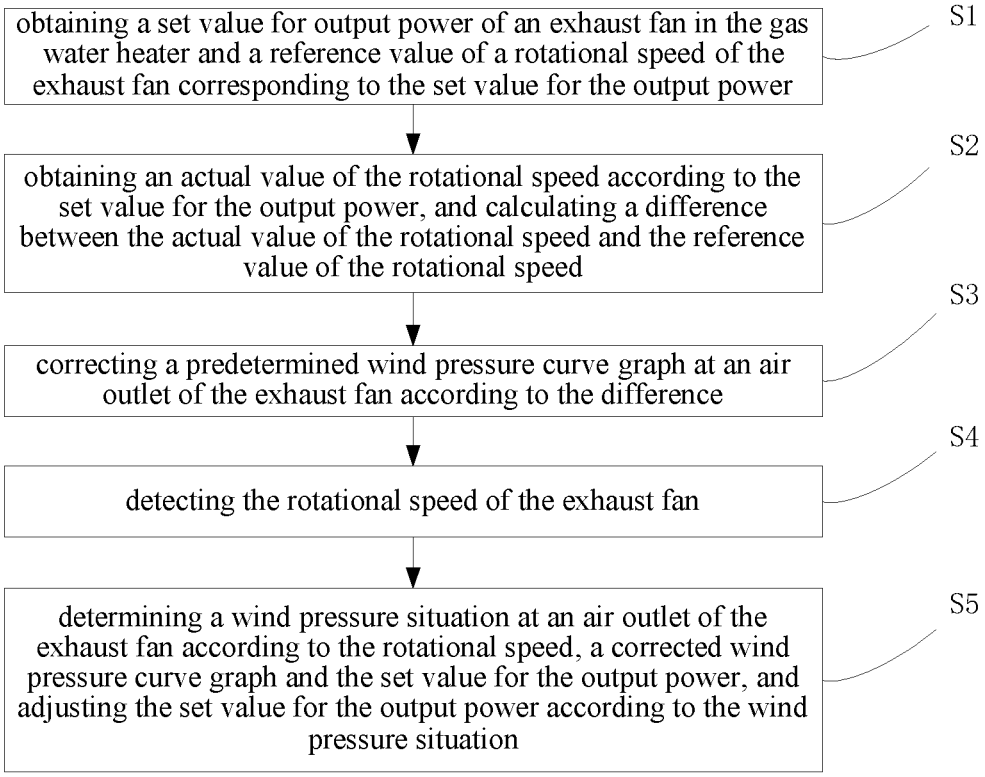
FIG. 6 is a flow chart of a safety control method for a gas water heater according to an embodiment of the present disclosure.

FIG. 6 is a flow chart of a safety control method for a gas water heater according to an embodiment of the present disclosure. As shown in FIG. 6, the safety control method includes following steps.

In step S1, a set value for output power of the exhaust fan is obtained and a reference value of rotational speed of the exhaust fan corresponding to the set value for output power is obtained.

In step S2, an actual value of the rotational speed of the exhaust fan is obtained according to the set value for output power, and a difference between the actual value of the rotational speed and the reference value of the rotational speed is calculated.

In step S3, a predetermined wind pressure curve graph at an air outlet of the exhaust fan is corrected according to the difference, in which the predetermined wind pressure curve graph includes a plurality of curves each indicating a predetermined rotational speed as a function of the set value for the output power.

In step S4, the rotational speed of the exhaust fan is detected.

In step S5, a wind pressure situation at an air outlet of the exhaust fan is determined according to the rotational speed, a corrected wind pressure curve graph and the set value for output power, and the set value for output power is adjusted according to the wind pressure situation.

Specifically, during the first operation of the gas water heater, the set value for the output power of the exhaust fan and the corresponding reference value of the rotational speed are obtained. Under a reference condition, a sampling and comparison program is executed. In other words, the actual value of the rotational speed is obtained according to the set value for the output power of the exhaust fan, and the difference between the actual value of the rotational speed and the reference value of the rotational speed is calculated. The predetermined wind pressure curve graph is corrected according to the difference between the actual value of the rotational speed and the reference value of the rotational speed, in which the predetermined wind pressure curve graph include a plurality of curves each indicating a predetermined rotational speed as a function of the set value for the output power (such as three predetermined rotational speeds). During this operation or later operation of the gas water heater, the rotational speed of the exhaust fan is detected in real time, the wind pressure situation at the air outlet of the exhaust fan is determined in combination with the corrected wind pressure curve graph and the set value for the output power of the exhaust fan, and then the set value for the output power of the exhaust fan is adjusted according to the wind pressure situation, such that the adjustment of air volume of the exhaust fan may be realized, and it is guaranteed that a good combustion condition may be achieved after mixing the introduced gas and air during the operation of the gas water heater, thus ensuring the safety and reliability of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved.

In an embodiment of the present disclosure, when the predetermined wind pressure curve graph is corrected according to the difference between the actual value of the rotational speed and the reference value of the rotational speed, the corrected wind pressure curve graph includes a plurality of curves each indicating a sum of the difference and the predetermined rotational speed as a function of the set value for the output power.

Further, determining a wind pressure situation at an air outlet of the exhaust fan according to the rotational speed, the corrected pressure curve graph and the set value for the output power and adjusting the set value for the output power according to the wind pressure situation includes: controlling the set value for the output power to be reduced by a first predetermined value when it is determined that the wind pressure situation is a low wind pressure situation; controlling the set value for the output power to keep unchanged when it is determined that the wind pressure situation is a medium wind pressure situation; and controlling the set value for the output power to be increased by a second predetermined value when it is determined that the wind pressure situation is a high wind pressure situation.

Specifically, as shown in FIG. 2, in the case of a certain set value for output power of the exhaust fan, if the rotational speed R of the exhaust fan is below the first curve R1+dn (Region I), it indicates that the wind pressure at the air outlet of the exhaust fan 10 is small, then the set value for output power of the exhaust fan is controlled to be reduced by the first predetermined value, i.e., the set value for output power is: $P=P-\Delta P1$, such that the output power of the exhaust fan is decreased; if the rotational speed R of the exhaust fan is above the first curve R1+dn but below the second curve R2+dn (Region II), it indicates that the wind pressure at the air outlet of the exhaust fan is appropriate and the rotational speed of the exhaust fan is naturally increased due to the physical characteristic of the exhaust fan as the wind pressure increases, such that it is unnecessary to adjust the set value for output power of the exhaust fan; if the rotational speed R of the exhaust fan is above the second curve R2+dn but below the third curve R3+dn (Region III), it indicates that the wind pressure at the air outlet of the exhaust fan is large, then the set value for output power of the exhaust fan is controlled to be increased by the second predetermined value, i.e., the set value for output power is: $P=P+\Delta P2$, such that the output power of the exhaust fan is increased. dn is the difference between the actual value of the rotational speed and the reference value of the rotational speed of the exhaust fan. Since there may be difference in the performances of different exhaust fans and performances of whole systems when the gas water heaters are produced in batches, the control accuracy of the gas water heater may be affected. Therefore, the difference correction may be performed on the rotational speed curve (predetermined wind pressure curve) of the exhaust fan based on the difference of the actual value of the rotational speed and the reference value of the rotational speed of the exhaust fan.

In other words, when the set value for output power of the exhaust fan is P1, if the detected rotational speed of the exhaust fan meets a condition of $R<C$, then the set value for output power of the exhaust fan is adjusted to $P1-\Delta P1$; if the rotational speed meets a condition of $C\leq R<B$, then the set value for output power of the exhaust fan is unchanged; if the rotational speed meets a condition of $B\leq R<A$, then the set value for output power of the exhaust fan is adjusted to $P1+\Delta P2$, such that the active control on the air volume of the exhaust fan is realized, and it is guaranteed that the air volume of the exhaust fan reaches an equilibrium with the wind pressure at the air outlet and the gas water heater would have a good combustion condition.

It should be understood that, the relationship between the set value for output power of the exhaust fan and each of the first curve R1+dn, the second curve R2+dn and the third curve R3+dn shown in FIG. 2 presents the corrected wind pressure curve. R1, R2 and R3 are the plurality of predetermined rotational speeds. Each of R1, R2 and R3 is a rotational speed value preset and stored in advance, and is configured to determine the wind pressure situation.

In addition, it should be noted that, the predetermined wind pressure curve graph may be corrected only when the gas water heater works for the first time, so as to reduce the safety control time of the gas water heater and the power consumption.

Further, determining a wind pressure situation at the air outlet of the exhaust fan according to the rotational speed, the corrected wind pressure curve graph and the set value for the output power and adjusting the set value for the output power according to the wind pressure situation further includes: controlling the gas water heater to shut off, when it is determined that the wind pressure situation is an extreme high wind pressure situation or the rotational speed is higher than a rotational speed threshold.

Specifically, as shown in FIG. 2, in a case of a certain set value for output power of the exhaust fan, if the rotational speed R of the exhaust fan is above the third curve R3+dn (Region IV), it indicates that the wind pressure at the air outlet of the exhaust fan is too high, then it is necessary to control the gas water heater to shut off. For example, when the set value for output power of the exhaust fan is P1, if the rotational speed of the exhaust fan meets a condition of R≥A, then the gas water heater is controlled to shut off. Alternatively, if the rotational speed of the exhaust fan is higher than a predetermined rotational speed threshold (upper limit for the rotational speed), then the gas water heater is controlled to shut off. In this way, the safety of the gas water heater is guaranteed.

According to an embodiment of the present disclosure, the above safety control method further includes: obtaining a water supply quantity of the gas water heater, a set temperature for output water of the gas water heater and a cold water temperature of the gas water heater; calculating a total heat required by the gas water heater according to the water supply quantity, the set temperature for the output water and the cold water temperature, and obtaining a current control instruction and an initial set value for the output power according to the total heat; and performing a gas burning control by controlling a proportional valve in a gas unit of the gas water heater according to the current control instruction.

Specifically, after the gas water heater is energized, firstly the total heat required by the gas water heater for warming the cold water to the set temperature for output water is calculated according to the set temperature for output water set by the user, the water supply quantity and the cold water temperature. And then, as shown in FIG. 4, the control quantity (i.e., the current control instruction) of the proportional valve in the gas unit and the set value for output power to be configured as an initial set value for output power are obtained according to the total heat required by the gas water heater. Finally, the proportional valve is controlled according to the obtained control quantity so as to control the gas unit, and the exhaust fan is controlled according to the initial set value for output power.

The rotational speed of the exhaust fan is detected in real time, and is determined. In the case of the initial set value for output power $P_{initial}$, if the detected rotational speed is located in region I of the corrected wind pressure curve graph shown in FIG. 2, then set value for output power of the exhaust fan 10 is $P=P_{initial}-\Delta P1$; if the detected rotational speed is located in region II, then set value for output power of the exhaust fan 10 is $P=P_{initial}$; if the detected rotational speed is located in region III, then set value for output power of the exhaust fan 10 is $P=P_{initial}+\Delta P2$. And so on, if the rotational speed of the exhaust fan 10 is located in region IV in the case of a certain set value for output power, or the rotational speed of the exhaust fan 10 is higher than the rotational speed threshold, or a shut-off instruction is received from the user, then the gas water heater is controlled to shut off.

During the operation of the gas water heater, if the set temperature for output water is changed, or the water supply quantity is changed, the control quantity of the proportional valve and the initial set value for output power are obtained again, and the gas water heater is controlled based on the above-mentioned procedure.

With the safety control method for a gas water heater according to embodiments of the present disclosure, firstly the set value for output power of the exhaust fan and corresponding reference value of the rotational speed are obtained, and the actual value of the rotational speed of the exhaust fan is obtained according to the set value for the output power and the difference between the actual value of the rotational speed and the reference value of the rotational speed is calculated, and the predetermined wind pressure curve graph at the air outlet of the exhaust fan is corrected according to the difference. And then, the rotational speed of the exhaust fan is detected, the wind pressure situation at the air outlet of the exhaust fan is determined according to the rotational speed, the corrected wind pressure curve graph and the set value for the output power, and the set value for the output power is adjusted according to the wind pressure situation, such that the adjustment of air volume of the exhaust fan may be realized, and it is guaranteed that a good combustion condition may be achieved after mixing the introduced gas and air during the operation of the gas water heater, thus ensuring a safe and reliable operation of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved.

In addition, there is provided a gas water heater according to embodiments of the present disclosure, which includes the above safety control system for a gas water heater.

With the above safety control system, the gas water heater according to embodiments of the present disclosure may correct the predetermined wind pressure curve graph at the air outlet of the exhaust fan according to the difference between the actual value of the rotational speed and the reference value of the rotational speed, determine the wind pressure situation at the air outlet of the exhaust fan according to the rotational speed, the corrected wind pressure curve graph and the set value for the output power and adjust the set value for the output power according to the wind pressure situation, such that the adjustment of air volume of the exhaust fan may be realized, and it is guaranteed that a good combustion condition may be achieved after mixing the introduced gas and air during the operation of the gas water heater, thus ensuring the safe and reliable operation of the gas water heater. Meanwhile, the direct adjustment of the set value for the output power is an active control, which not only has a fast response speed but also provides more accurate air volume when compared to the passive control on the rotational speed of the exhaust fan, such that the control accuracy is improved.

In the specification, it is to be understood that terms such as "central," "longitudinal", "lateral", "length," "width," "thickness," "upper," "lower," "front," "rear," "left," "right," "vertical," "horizontal," "top," "bottom," "inner," "outer," "clockwise," "counterclockwise," "axial," "radial," and "circumferential" should be construed to refer to the orientation or the position as then described or as shown in the drawings under discussion. These relative terms are only used to simplify description of the present disclosure, and do not indicate or imply that the device or element referred to must have a particular orientation, or constructed or operated in a particular orientation. Thus, these terms cannot be constructed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it would be appreciated by those skilled in the art that changes, modifications, alternatives and variations can be made in the embodiments without departing from the scope of the present disclosure.

What is claimed is:

1. A safety control system for a gas water heater, comprising:

an exhaust fan, configured to exhaust waste gas generated when the gas water heater burns gas;

a rotational speed detecting unit, configured to detect a rotational speed of the exhaust fan;

a power obtaining unit, configured to obtain a set value for output power of the exhaust fan;

a rotational speed difference obtaining unit, configured to obtain an actual value of the rotational speed and a reference value of the rotational speed according to the set value for the output power, and to calculate a difference between the actual value of the rotational speed and the reference value of the rotational speed; and an exhaust control unit, connected to the exhaust fan, the rotational speed detecting unit, the rotational speed difference obtaining unit and the power obtaining unit respectively, and configured to correct a predetermined wind pressure curve graph at an air outlet of the exhaust fan according to the difference, to determine a wind pressure situation at the air outlet according to the rotational speed, a corrected wind pressure curve graph and the set value for the output power, and to adjust the set value for the output power according to the wind pressure situation, wherein the predetermined wind pressure curve graph comprises a plurality of curves each indicating a predetermined rotational speed as a function of the set value for the output power.

2. The safety control system according to claim 1, wherein the exhaust control unit is configured to correct the predetermined wind pressure curve at an air outlet of the exhaust fan according to the difference by making the corrected wind pressure curve graph comprise plurality of curves each indicating a sum of the difference and the predetermined rotational speed as a function of the set value for the output power.

3. The safety control system according to claim 2, wherein the exhaust control unit is configured to determine a wind pressure situation at the air outlet according to the rotational speed, a corrected wind pressure curve graph and the set value for the output power and to adjust the set value for the output power according to the wind pressure situation by performing following acts:

controlling the set value for the output power to be reduced by a first predetermined value when the exhaust control unit determines that the wind pressure situation is a low wind pressure situation;

controlling the set value for the output power to keep unchanged when the exhaust control unit determines that the wind pressure situation is a medium wind pressure situation; and controlling the set value for the output power to be increased by a second predetermined value when the exhaust control unit determines that the wind pressure situation is a high wind pressure situation.

4. The safety control system according to claim 1, further comprising a system control unit configured to perform a mutual communication with the exhaust control unit, wherein the exhaust control unit is configured to send a shut-off signal to the system control unit such that the system control unit controls the gas water heater to shut off according to the shut-off signal, when the exhaust control unit determines that the wind pressure situation is an extreme high wind pressure situation or the rotational speed is higher than a rotational speed threshold.

5. The safety control system according to claim 4, further comprising:

a water supply unit, connected to the system control unit; and a temperature obtaining unit, connected with the system control unit, configured to obtain a set temperature for output water of the gas water heater and a cold water temperature of the gas water heater, wherein, the system control unit is configured to calculate a total heat required by the gas water heater according to a water supply quantity of the water supply unit, the set temperature for the output water and the cold water temperature, and to obtain a current control instruction and an initial set value for the output power according to the total heat.

6. The safety control system according to claim 5, further comprising:

a gas unit, connected to the system control unit and provided with a proportional valve, wherein the system control unit is configured to control the gas unit by controlling the proportional valve according to the current control instruction.

7. The safety control system according to claim 1, wherein the gas water heater is a forced exhaust type gas water heater.

8. A gas water heater, comprising:

a safety control system for a gas water heater, comprising:

an exhaust fan, configured to exhaust waste gas generated when the gas water heater burns gas;

a rotational speed detecting unit, configured to detect a rotational speed of the exhaust fan;

a power obtaining unit, configured to obtain a set value for output power of the exhaust fan;

a rotational speed difference obtaining unit, configured to obtain an actual value of the rotational speed and a reference value of the rotational speed according to the set value for the output power, and to calculate a difference between the actual value of the rotational speed and the reference value of the rotational speed; and an exhaust control unit, connected to the exhaust fan, the rotational speed detecting unit, the rotational speed difference obtaining unit and the power obtaining unit respectively, and configured to correct a predetermined wind pressure curve graph at an air outlet of the exhaust fan according to the difference, to determine a wind pressure situation at the air outlet according to the rotational speed, a corrected wind pressure curve graph and the set value for the output power, and to adjust the set value for the output power according to the wind pressure situation, wherein the predetermined wind pressure curve graph comprises a plurality of curves each indicating a predetermined rotational speed as a function of the set value for the output power.

9. A safety control method for a gas water heater, comprising:

obtaining a set value for output power of an exhaust fan in the gas water heater and a reference value of a rotational speed of the exhaust fan corresponding to the set value for the output power;

obtaining an actual value of the rotational speed according to the set value for the output power, and calculating a difference between the actual value of the rotational speed and the reference value of the rotational speed;

correcting a predetermined wind pressure curve graph at an air outlet of the exhaust fan according to the difference, wherein the predetermined wind pressure curve graph comprises a plurality of curves each indicating a predetermined rotational speed as a function of the set value for the output power;

detecting the rotational speed of the exhaust fan; and determining a wind pressure situation at an air outlet of the exhaust fan according to the rotational speed, a corrected wind pressure curve graph and the set value for the output power, and adjusting the set value for the output power according to the wind pressure situation.

10. The safety control method according to claim 9, wherein correcting a predetermined wind pressure curve graph at an air outlet of the exhaust fan according to the difference comprises:

making the corrected wind pressure curve graph comprise a plurality of curves each indicating a sum of the difference and the predetermined rotational speed as a function of the set value for the output power.

11. The safety control method according to claim 10, wherein determining a wind pressure situation at an air outlet of the exhaust fan according to the rotational speed, a corrected wind pressure curve graph and the set value for the output power, and adjusting the set value for the output power according to the wind pressure situation comprises:

controlling the set value for the output power to be reduced by a first predetermined value when it is determined that the wind pressure situation is a low wind pressure situation;

controlling the set value for the output power to keep unchanged when it is determined that the wind pressure situation is a medium wind pressure situation; and controlling the set value for the output power to be increased by a second predetermined value when it is determined that the wind pressure situation is a high wind pressure situation.

12. The safety control method according to claim 9, wherein determining a wind pressure situation at an air outlet of the exhaust fan according to the rotational speed, a corrected wind pressure curve graph and the set value for the output power, and adjusting the set value for the output power according to the wind pressure situation further comprises:

controlling the gas water heater to shut off, when it is determined that the wind pressure situation is an extreme high wind pressure situation or the rotational speed is higher than a rotational speed threshold.

13. The safety control method according to claim 9, further comprising:

obtaining a water supply quantity of the gas water heater, a set temperature for output water of the gas water heater and a cold water temperature of the gas water heater;

calculating a total heat required by the gas water heater according to the water supply quantity, the set temperature for the output water and the cold water temperature, and obtaining a current control instruction and an initial set value for the output power according to the total heat; and performing a gas burning control by controlling a proportional valve in a gas unit of the gas water heater according to the current control instruction.

* * * * *